United States Patent [19]

Thoma

[11] 4,287,810

[45] Sep. 8, 1981

[54] DRIVE FOR A PNEUMATIC HAMMER

[75] Inventor: Hans Thoma, Neuhausen am Rheinfall, Switzerland

[73] Assignee: SIG - Schweizerische Industrie-Gesellschaft, Neuhausen am Rheinfall, Switzerland

[21] Appl. No.: 37,050

[22] Filed: May 8, 1979

[30] Foreign Application Priority Data

May 12, 1978 [DE] Fed. Rep. of Germany ..... 2820842

[51] Int. Cl.[3] ..... F01L 25/02; F01L 21/02

[52] U.S. Cl. ..... 91/299; 91/317; 91/325

[58] Field of Search ..... 91/325, 317, 299, 402

[56] References Cited

U.S. PATENT DOCUMENTS

| | | | |
|---|---|---|---|
| 1,401,866 | 12/1921 | Bosch | 91/325 |
| 2,695,596 | 11/1954 | Neil | 91/325 |
| 2,899,934 | 8/1959 | Salengro | 91/317 |
| 3,053,329 | 9/1962 | Fairchild | 91/25 |
| 3,232,178 | 2/1966 | Sanduig | 91/317 |
| 3,916,982 | 11/1975 | Blower et al. | 91/325 |
| 4,071,094 | 1/1978 | Kilin . | |

FOREIGN PATENT DOCUMENTS

| | | |
|---|---|---|
| 1503156 | 9/1970 | Fed. Rep. of Germany . |
| 2360430 | 6/1974 | Fed. Rep. of Germany . |
| 580476 | 10/1976 | Switzerland . |

*Primary Examiner*—Paul E. Maslousky
*Attorney, Agent, or Firm*—Spencer & Kaye

[57] ABSTRACT

A pneumatic drive for a hammer tool has a cylinder; a piston slidably received in the cylinder and dividing the inner space of the cylinder into two cylinder chambers; a drive output member formed as a piston rod attached to the piston and projecting from the cylinder; a pressure-responsive valve for admitting compressed air alternately to the cylinder chambers; and a plurality of spaced, serially arranged cylindrical discharge ports in the cylinder wall for releasing compressed air alternately from the cylinder chambers dependent upon the position of the piston with respect to the discharge ports.

3 Claims, 3 Drawing Figures

DRIVE FOR A PNEUMATIC HAMMER

BACKGROUND OF THE INVENTION

This invention relates to a pneumatic hammer tool and more particularly, it is concerned with the pneumatic drive therefor. The drive has a cylinder and a differential piston which is slidably received in the cylinder and which has a piston rod projecting outwardly of the cylinder for cooperating with a tool bit, such as a chisel-shaped member. A pressure-controlled valve arrangement alternatingly routes compressed air in the two cylinder chambers at the one and the other side of the piston for causing reciprocation thereof. The cylinder wall is provided with at least one discharge opening which, controlled by the land of the reciprocating piston, alternatingly connects the one and the other cylinder chamber with the atmosphere to depressurize and release the compressed air from the respective cylinder chamber after the compressed air has displaced the piston.

Pneumatic hammers of the above-outlined type are known; they have a high impact rate and a superior output but are disadvantageous in that they operate with substantial noise. Swiss Pat. No. 580,476 discloses a pneumatic hammer in which a significant noise suppression is achieved by providing the piston at each end with conical chamfers which cooperate with discharge slots of very substantial length (as measured in a direction generally perpendicular to the direction of reciprocation of the piston). It has been found, however, that the long discharge slots cause substantial wear because the cylinder has, at the height level of the long slots, a relatively small surface that slidingly supports the piston.

SUMMARY OF THE INVENTION

It is an object of the invention to provide an improved pneumatic hammer in which the noise level is further lowered and, at the same time, the wear of the cylinder wall and the piston are reduced.

This object and others to become apparent as the specification progresses, are accomplished by the invention, according to which, briefly stated, the above-discussed discharge openings of the cylinder are constituted by a plurality of spaced, serially arranged cylindrical ports.

DESCRIPTION OF THE PREFERRED EMBODIMENT

Figure 1:
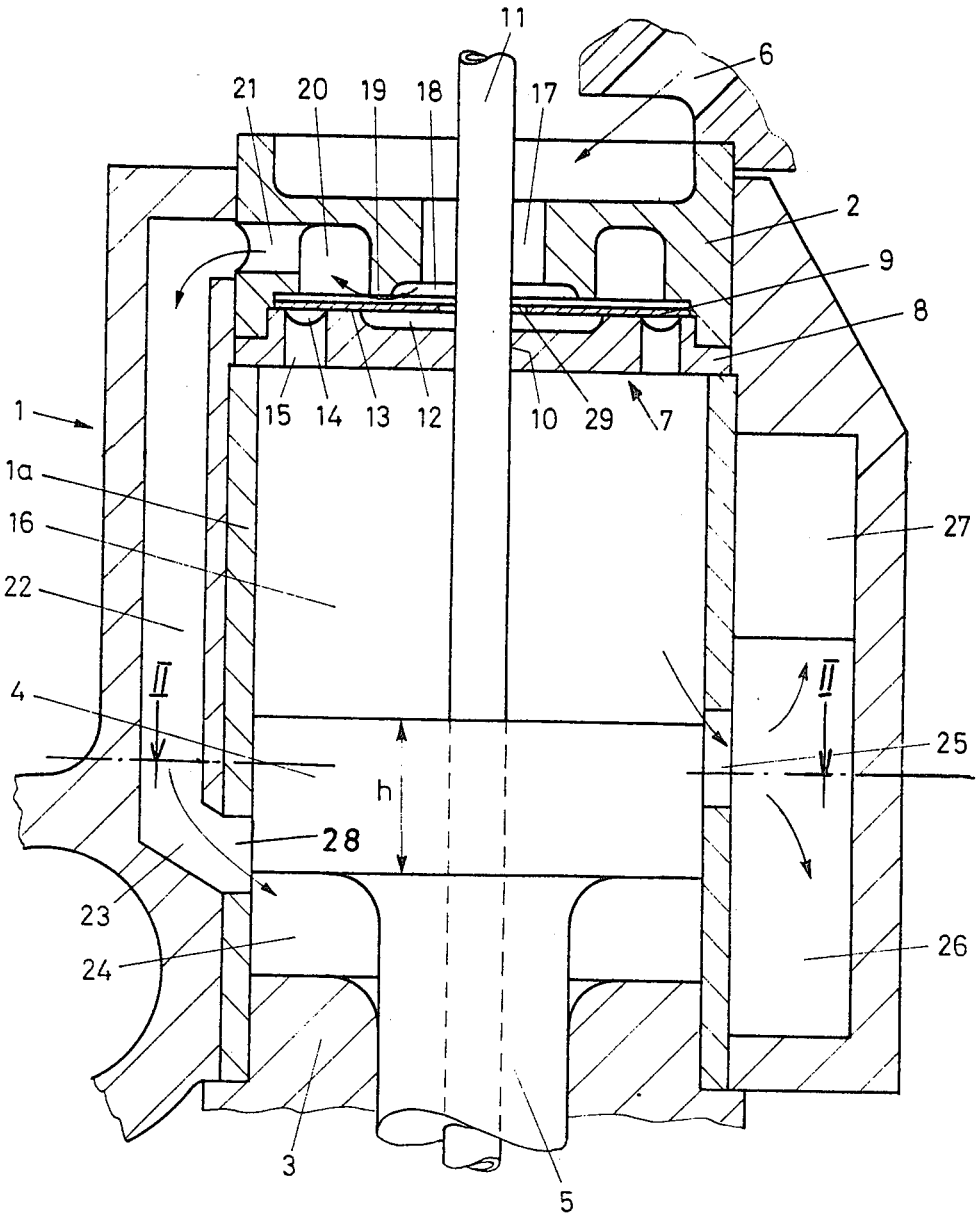
FIG. 1 is an axial sectional view of a preferred embodiment of the invention, taken along line I—I of FIG. 2.

Turning now to FIG. 1, the illustrated drive of a pneumatic hammer according to the invention has a housing 1 containing a cylinder 1*a* in which there is slidably received a differential piston 4. Both ends of the housing 1 as well as the cylinder 1*a* are closed off by end closures 2 and 3. The piston 4 has a piston rod 5 which extends through the end closure 3 and is operatively coupled, in a known manner not illustrated, with an impacting tool bit, such as a chisel. A plate valve generally indicated at 7 is provided for the control of compressed air which is admitted to the tool drive from an air compressor by means of a duct formed in an only fragmentarily shown hood 6. The plate valve 7 has a disc-like stationary valve body 8 and a movable valve plate 9. The valve body 8 which is, along its edge zones, clamped between the end closure 2 and a radial end face of the cylinder 1*a*, has a central opening 10 through which passes a pipe 11 which also extends through the piston 4 and the piston rod 5. The pipe 11 serves for supplying the tool with spray water in a conventional manner.

The valve body 8 has, on its face oriented away from the cylinder 1*a*, a shallow depression 12 which is surrounded by an annular lower seat 13 for the valve plate 9. In the seat 13 there is provided an annular groove 14 which is in communication with an upper cylinder chamber 16 by means of a series of apertures 15 provided in the valve body 8. The end closure 2 further has a central inlet channel 17 which opens into a shallow recess 18 of the end closure 2. The recess 18 is surrounded by an annular upper seat 19 for the valve plate 9. In the seat 19 there is provided an annular groove 20 which is in communication with a lower cylinder chamber 24 by means of two passages, each formed of a radial port 21 provided in the end closure 2, an axially parallel channel 22 and an oblique channel 23 provided in the housing 1 and an opening 28 provided in the cylinder 1*a*. For the discharge of the alternately expanding compressed air in the cylinder chambers 16 and 24, the cylinder 1*a* has five cylindrical ports 25 arranged in a series. The discharge ports 25 are intermittently blocked by the land of the piston 4, dependent upon its position, as will be described below.

Figure 2:
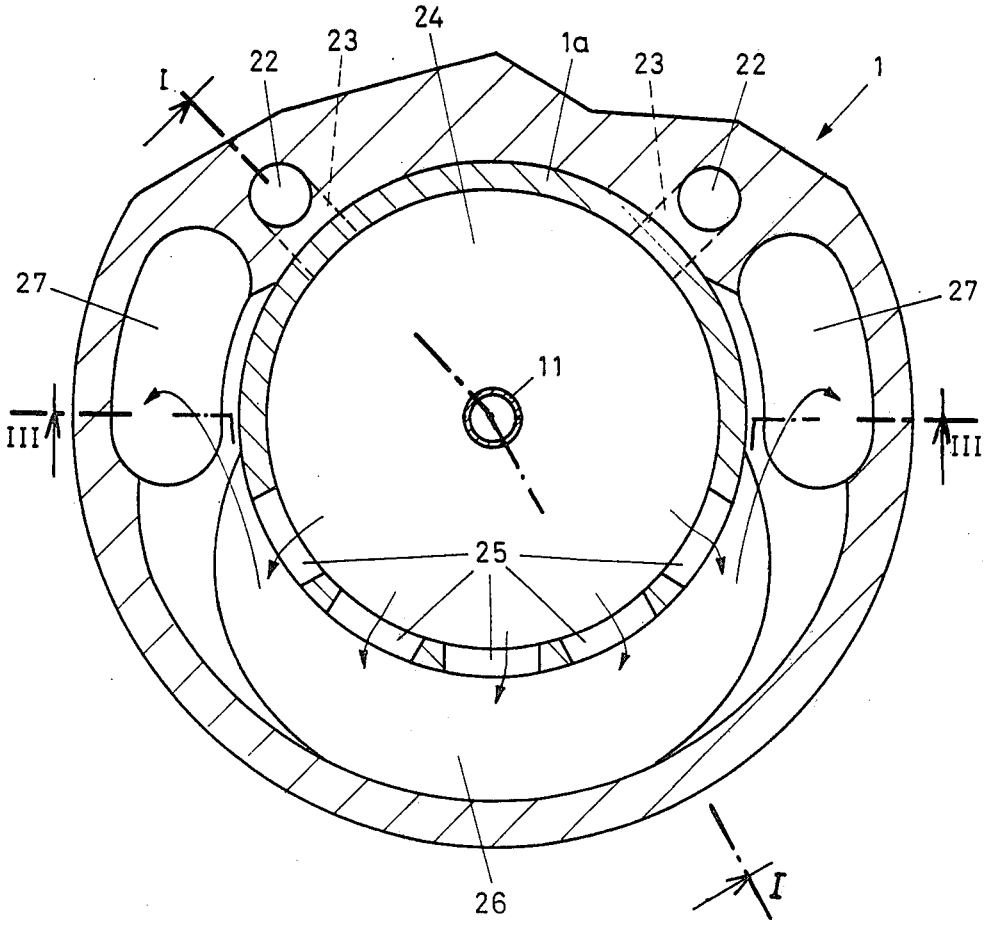
FIG. 2 is a sectional view taken along line II—II of FIG. 1 (with the piston omitted).
Figure 3:
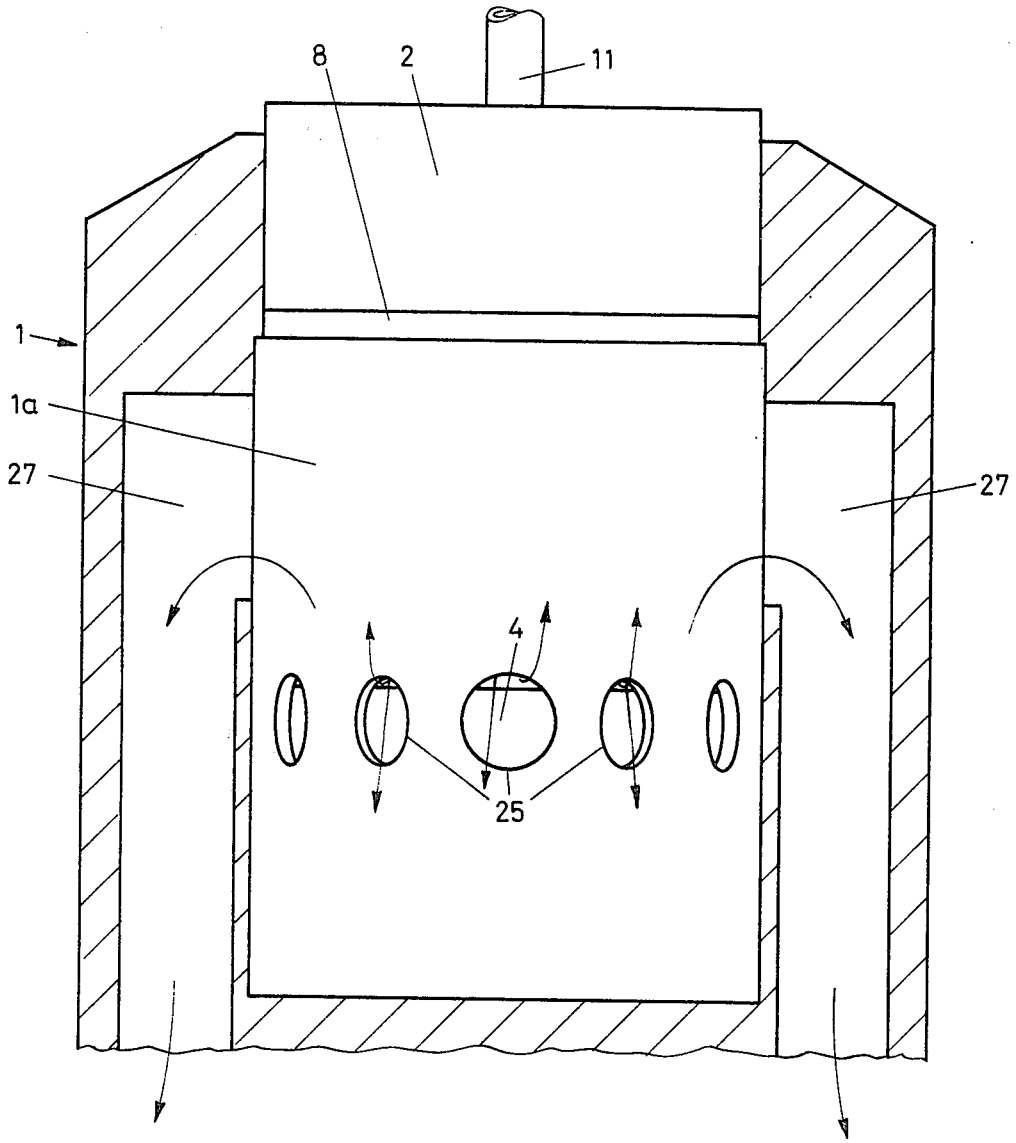
FIG. 3 is a sectional view taken along line III—III of FIG. 1.

The ports 25 open into a first expansion chamber 26 which is in communication with two second expansion chambers 27, as shown in FIG. 2. From the second expansion chambers 27 the expanded compressed air is discharged into the atmosphere as illustrated in FIG. 3.

The mode of operation of the hammer drive described above is generally known; it will be summarized below for aiding in the understanding of the invention.

In the position of the piston 4 illustrated in FIG. 1, the upper cylinder chamber 16 (that is, the cyclinder chamber bounded by the upper radial face of the piston 4) is in communication with the ambient atmosphere via the discharge ports 25 and the expansion chambers 26 and 27 so that the compressed air in the lower cylinder chamber 24 can displace the piston 4 upwardly. The lower cylinder chamber 24 is supplied with compressed air as it passes from the channel 17 through the valve body 8 between the valve plate 9 and the upper seat 19, then through the channels 22 and 23 into the lower cylinder chamber 24. As the piston 4, in the course of its upward movement, blocks and then moves past the discharge ports 25, compressed air flows from the lower cylinder chamber 24 through the discharge ports 25 into the expansion chambers 26 and 27 and therefrom into the atmosphere. This is so because at this time the piston 4 has been raised sufficiently to shift the limits of the lower cylinder chamber 24 (which is bounded by the lower radial face of the piston 4) to such an extent that it includes the discharge ports 25. At the same time, air in the upper cylinder chamber 16 is compressed to such an extent that it lifts the valve plate 9 from the lower seat 13 and presses it against the upper seat 19. Compressed air now passes through the central opening 29 of the valve plate 9 and between the seat 13 and the valve plate 9 into the upper cylinder chamber 16 via the groove 14 and the openings 15. The pressure now exerted on the large upper radial face of the differential piston 4 brakes the piston 4 in its upward movement (return stroke) and initiates the impacting stroke.

When the piston 4 has passed beyond the discharge ports 25 during its downward motion (impacting stroke) and the air compressed in the lower cylinder chamber 24 has again pressed the valve plate 9 onto the lower valve seat 13, the return stroke (upward motion of the piston 4) is initiated, whereupon the above-described cycle is repeated.

The plate valve 7 which is thus controlled by the compressed air and which includes the lower portion of the closure 2, has, as known, the significant advantage that it responds very rapidly. For example, in case of an air pressure of 3 to 7 gage pressure, approximately 1000 to 2000 powerful blows/minute can be performed. It is to be understood, however, that any other type of compressed air-controlled valve may be used such as, for example, a conventional tubular shuttle valve. By virtue of the arrangement of the relatively large cylindrical discharge ports 25 and the adjoining expansion chambers 26 and 27, the noise generation is very substantially suppressed. The wall portions extending between the individual discharge ports 25 provide for a good (large-area) guidance for the piston 4 and thus the wear of the slidingly engaging components is reduced.

The diameter of the discharge ports 25 is preferably larger than one-half of the height h of the piston 4. For a given piston diameter of 80 to 120 mm, the diameter of the discharge ports 25 is preferably between 17 to 22 mm.

As best seen in FIG. 2, the second expansion chamber—which communicates with the first expansion chamber 26—is formed of two chambers 27; they are coupled in parallel and are of identical dimensions. It is feasible, however, to provide second expansion chambers of different sizes or to provide only a single second expansion chamber.

It is to be understood that the above description of the present invention is susceptible to various modifications, changes and adaptations, and the same are intended to be comprehended within the meaning and range of equivalents of the appended claims.

What is claimed is:

1. In a pneumatic drive for a hammer tool including a cylinder; a piston slidably received in the cylinder and dividing the inner space of the cylinder into two cylinder chambers; a drive output member formed as a piston rod attached to the piston and projecting from the cylinder; a pressure-responsive valve means for admitting compressed air alternately to the cylinder chambers; means defining discharge openings in the cylinder wall for releasing compressed air alternately from the cylinder chambers dependent upon the position of said piston with respect to the discharge openings; the improvement wherein said discharge openings consist of a plurality of spaced, serially arranged cylindrical ports each having a diameter that equals at least one half of the height of said piston measured in the direction of its reciprocation and means defining a first expansion chamber directly communicating with said cylindrical ports and two second expansion chambers each communicating directly with said first expansion chamber.

2. A pneumatic drive as defined in claim 1, wherein said piston has a diameter of between 80 and 120 mm and further wherein said cylindrical ports are five in number and each is of identical size, each having a diameter of between 17 and 22 mm.

3. A pneumatic drive as defined in claim 1, wherein said second expansion chambers are identically dimensioned.

* * * * *